United States Patent [19]

Scherrer et al.

[11] 4,071,133

[45] Jan. 31, 1978

[54] CASSETTE FOR DYE IMPREGNATED RIBBON

[75] Inventors: Herbert Scherrer, Pfaffikon; Ernst Bopp; Ennio Cecchetto, both of Zurich, all of Switzerland

[73] Assignee: Franz Büttner AG., Zurich, Switzerland

[21] Appl. No.: 672,127

[22] Filed: Mar. 31, 1976

[30] Foreign Application Priority Data

Nov. 8, 1975 Germany ..... 2551677

[51] Int. Cl.[2] ..... B41J 33/10

[52] U.S. Cl. ..... 197/168; 197/151; 197/171; 118/268

[58] Field of Search ..... 197/151, 168, 171; 118/204, 206, 211, 216, 221, 225, 255, 264, 268, 269, 401

[56] References Cited

U.S. PATENT DOCUMENTS

| | | | |
|---|---|---|---|
| 2,005,503 | 6/1935 | Pelton | 197/171 |
| 2,226,347 | 12/1940 | Pelton | 197/171 |
| 2,304,832 | 12/1942 | Kofke et al. | 118/268 UX |
| 2,475,336 | 7/1949 | Petz | 197/168 |
| 2,645,202 | 7/1953 | Knight | 197/171 X |
| 3,232,406 | 2/1966 | Schwartz | 197/171 |
| 3,241,522 | 3/1966 | Knight | 197/171 X |
| 3,621,968 | 11/1971 | Kondur | 197/151 |
| 3,831,731 | 8/1974 | Mack et al. | 197/171 X |
| 3,863,749 | 2/1975 | Perry et al. | 197/151 |
| 3,904,015 | 9/1975 | Boyden et al. | 197/151 |

FOREIGN PATENT DOCUMENTS

| | | | |
|---|---|---|---|
| 2,136,777 | 2/1973 | Germany | 197/168 |
| 29,235 of | 1913 | United Kingdom | 197/168 |

*Primary Examiner*—Ernest T. Wright, Jr.
*Attorney, Agent, or Firm*—Ernest F. Marmorek

[57] ABSTRACT

A cassette, for use in connection with a device for printing characters on a surface from the stroke impact of an endless dye impregnated ribbon such as a typewriter, the device defining a stroke region, features a housing defining two chambers, one of the chambers providing a storage region, the housing having a passageway for the ribbon, the passageway interconnecting with the storage region and being adapted to communicate with the stroke region, the ribbon being adapted to move between the stroke area and the storage region, re-impregnating means disposed in the other chamber and operable for re-impregnating the ribbon with dye, and transport means disposed substantially between the chambers and the passageway and operable for transporting the ribbon and for maintaining the ribbon substantially stretched in the stroke region.

1 Claim, 6 Drawing Figures

CASSETTE FOR DYE IMPREGNATED RIBBON

BACKGROUND OF THE INVENTION

The invention relates to a cassette for use in connection with a device for printing characters on a surface from the stroke impact of an endless dye impregnated ribbon such as a typewriter.

Generally, cassettes using an endless typewriter ribbon have been used for typewriters and, particularly, high-speed typewriters. Within the cassette, transport means are provided to move the ribbon in correspondence with the typing process and to retain the ribbon substantially stretched in the stroke region of the typewriter. The length of the ribbon is selected to provide an opportunity to re-impregnate the ribbon before each part of it is typed on a further time. This, of course, extends the useful life of the ribbon.

Generally, it is estimated that an ordinary textile typewriter ribbon having a width of about 6.35 mm and a length of about 13 m can be used to print legibly about 600,000 to 800,000 characters at a typing rate of about 30 characters per second. Based on this, such a ribbon is completely used up over a period of about 8 hours, about a normal working day. A more careful study indicates that the time for re-impregnating the actual typing region of the ribbon from the adjacent area is usually not sufficient so that the actual performance is not as good as the estimated performance.

One prior art attempt to improve the useful life of the cassette ribbon utilizes inking rollers along the path of the ribbon within the typewriter. It has been determined that without the use of pressure or centrifugal force, very little ink is communicated from the inking rollers to the ribbon in contact therewith.

Another prior art attempt to overcome the problem utilizes a sponge saturated with ink and disposed within the cassette in contact with the ribbon. This embodiment did not use any storage area for the ribbon and relies on the continuous contact of the ribbon with the sponge to achieve re-impregnating of the ribbon. The results obtained have been unsatisfactory.

Generally, the re-impregnating of a ribbon with dye during the use of the ribbon presents some difficulty because the stroke impact compresses the ribbon during the typing process and thereby disturbs the physical properties of the ribbon in the vicinity of impact.

SUMMARY OF THE INVENTION

One of the principal objects of the invention is a cassette, for use in connection with a device for printing characters on a surface from the stroke impact of an endless dye impregnated ribbon such as a typewriter, the device defining a stroke region, including a housing defining two chambers, one of the chambers providing a storage region, the housing having a passageway for the ribbon, the passageway intercommunicating with the storage region and being adapted to communicate with the stroke region, the ribbon being adapted to move between the stroke area and the storage region, re-impregnating means disposed in the other chamber and operable for impregnating the ribbon with dye; and transport means disposed substantially between the chambers and the passageway and operable for transporting the ribbon and for maintaining the ribbon substantially stretched in the stroke region.

Another embodiment of the invention further includes re-impregnating means including a capillary writing device such as a writing felt tip.

Another embodiment of the invention further includes the re-impregnating means including a forked member for re-impregnating the portions of the ribbon adjacent to the area of the stroke impact of the ribbon.

Another embodiment of the invention further includes the re-impregnating means including a plurality of rollers aligned in the fashion of a multi-roller-printing machine for carrying the dye onto the ribbon.

Further objects and advantages of the invention will be set forth in part in the following specification and in part will be obvious therefrom without being specifically referred to, the same being realized and attained as pointed out in the claims hereof.

The invention accordingly comprises the features of construction, a combination of elements and arrangement of parts which will be exemplified in a construction he hereinafter set forth and the scope of the application of which will be indicated in the claims.

BRIEF DESCRIPTION OF THE DRAWING

For a fuller understanding of the nature and objects of the invention, reference should be had to the following detailed description, taken in connection with the accompanying drawing, in which.

DESCRIPTION OF THE PREFERRED EMBODIMENTS

Figure 1:
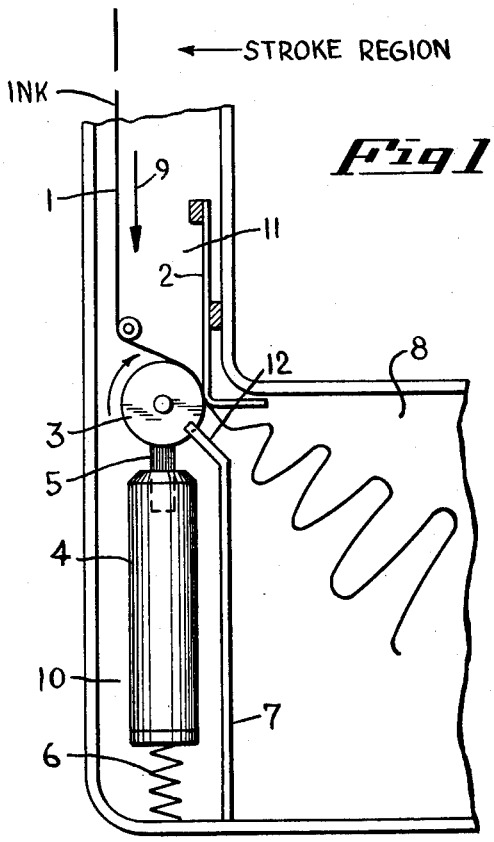
FIG. 1 is a fragmentary schematic plan view partly in section with the cover removed of one embodiment of the invention.

In carrying the invention into effect, several embodiments have been selected for illustration in the accompanying drawing and for description in the specification, reference being had to FIGS. 1 to 6.

In this specification and in the claims, the term "dye" includes ink, paste, and the like for use in impregnating and/or re-impregnating a ribbon of the type referred to herein. In addition, the terms "inking" and "re-inking" are used herein in a general sense and correspond to the terms "impregnating" and "re-impregnating", respectively.

An endless dye impregnated ribbon such as an inked typewriter ribbon 1 moves through a passageway 11 defined in the cassette in the direction of the arrow 9. A chamber 8 serves as a storage region for the ribbon 1 and a chamber 10 is used for a re-impregnating means such as re-inking unit 4.

Transport means such as roller 3 is disposed between the chambers 8 and 10 and the passageway 11.

The re-inking unit 4 includes a capillary writing device such as a writing wick or felt tip 5 communicating with the ink inside the re-inking unit 4 in order to carry the ink to the surface of the roller 3. A spring 6 urges the re-inking unit towards the roller 3 to establish a firm contact therebetween. The ribbon 1 is pressed against the roller 3 by a spring 2 in order to assure the transfer of ink from the surface of the roller 3 onto the ribbon 1. The separating wall 7 between the chambers 8 and 10 has a tongue-like member 12 which serves as a stripping agent to separate the ribbon 1 from the roller 3.

Figure 2:
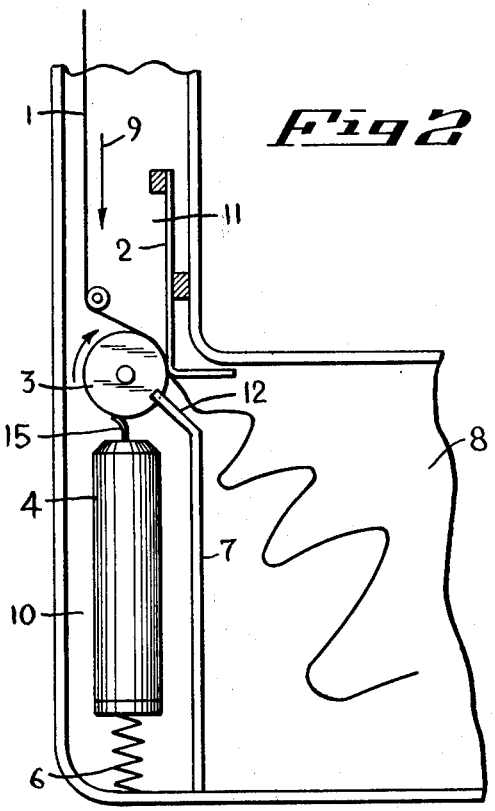
FIG. 2 is a fragmentary schematic plan view partly in section with the cover removed of another embodiment of the invention.

The embodiment shown in FIG. 2 is similar to the embodiment shown in FIG. 1 but uses a tongue-like member 15 in place of the felt tip 5. The tongue-like member 15 is shown in detail in FIGS. 5 and 6. Generally, a typewriter ribbon has a stroke impact region near its central portion. The member 15 re-inks the ribbon 1 on the portions of the ribbon 1 adjacent to the impact region of the ribbon 1.

This is accomplished by the member 15 being provided with slits 17 in its tongues 18, so that ink may be delivered from unit 4 to the roller-engaging tips of the tongues 18 of member 15 by capillary action.

Figure 3:
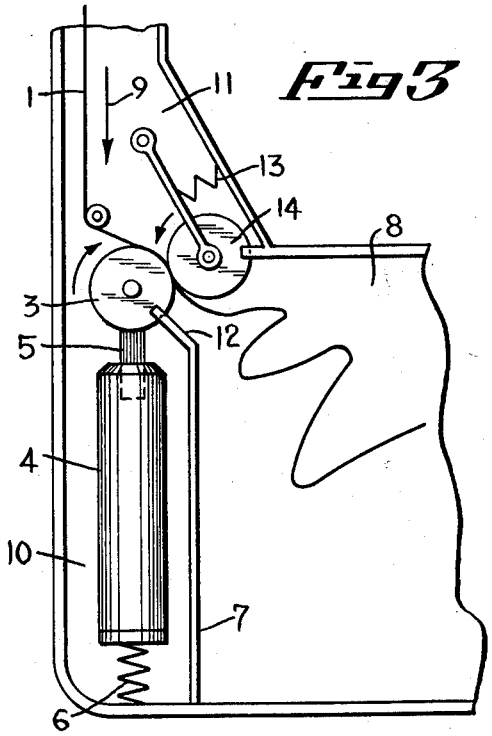
FIG. 3 is a fragmentary schematic plan view partly in section with the cover removed of a further embodiment of the invention.

The embodiment shown in FIG. 3 is similar to the embodiment shown in FIG. 1 in many of its features but instead of the spring 2, there is a roller 14 urged against the ribbon 1 by a spring 13.

Figure 4:
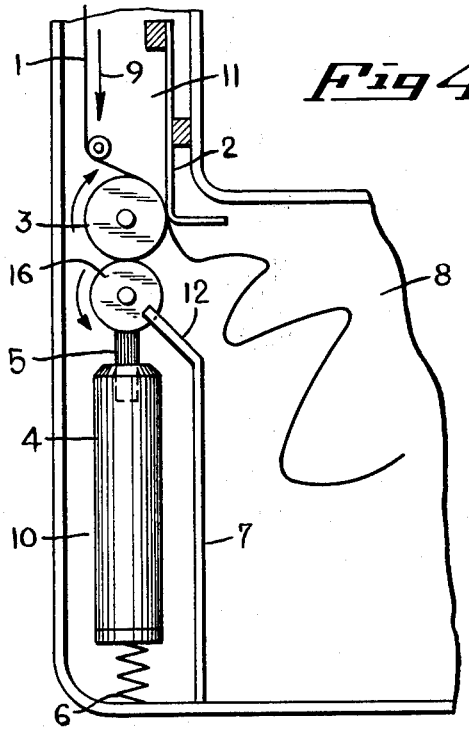
FIG. 4 is a fragmentary schematic plan view partly in section with the cover removed of yet another embodiment of the invention.
Figure 5:
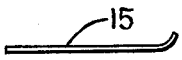
FIG. 5 is a side view of an element of FIG. 2.
Figure 6:
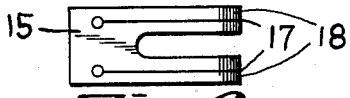
FIG. 6 is a top view of the element shown in FIG. 5.

The ink transfer for FIG. 4 takes a form similar to that found in a multi-roller-printing machine. A roller 16 contacts the felt tip 5 and carries the ink up to the roller 3. This arrangement has the advantage of obtaining a uniform distribution of the ink so that the re-inking of the ribbon 1 is uniform.

OPERATION

Generally, the ribbon 1 moves through the passageway 11 in the direction of the arrow 9 from a stroke region defined by the typewriter. The ribbon 1 is moved by the transport means into the storage region defined by the chamber 8. Just before the ribbon 1 moves into the chamber 8 it is re-inked by the re-impregnating means which cooperates with the transport means. The ribbon 1 leaves the chamber 8 and moves to the stroke region and continues the cycle.

The ribbon 1 can be composed of a textile material saturated with a liquid typewriter ribbon ink as well as a plastic carbon ribbon having a sponge-like ink releasing coating. In addition, the refilling units can be exchangeable and it is possible to arrange two cartridges, one on top of another, for two colored typewriter ribbons.

We wish it to be understood that we do not desire to be limited to the exact details of construction shown and described, for obvious modifications will occur to a person skilled in the art.

Having thus described the invention, what we claim as new and desire to be secured by Letters Patent, is as follows:

1. A cassette, for use in connection with a device for printing characters on a surface from the stroke impact of a central portion of an endless dye impregnated ribbon such as a typewriter, said device defining a stroke region, comprising, in combination:

a housing defining two chambers, one of said chambers providing a storage region, said housing having a passageway for said ribbon, said passageway intercommunicating with said storage region and communicating with said stroke region, said ribbon being movable between said stroke region and said storage region;

re-impregnating means disposed in the other chamber and comprising a forked member and being operable for re-impregnating said ribbon with dye by impregnating portions of said ribbon adjacent to said central portion; and transport means disposed substantially between said chambers and said passageway and operable for transporting said ribbon and for maintaining said ribbon substantially stretched in said stroke region.

* * * * *